United States Patent [19]

Umezono et al.

[11] 3,998,670

[45] Dec. 21, 1976

[54] PROCESS FOR PRODUCING STEEL PLATE SUBSTRATES FOR LACQUERING

[75] Inventors: Akimi Umezono; Minoru Kitayama; Takao Saito; Ryousuke Wake, all of Himeji, Japan

[73] Assignee: Nippon Steel Corporation, Tokyo, Japan

[22] Filed: May 29, 1975

[21] Appl. No.: 581,780

Related U.S. Application Data

[63] Continuation of Ser. No. 355,662, April 30, 1973, abandoned.

[30] Foreign Application Priority Data

May 4, 1972 Japan ..... 47-44417
Mar. 20, 1973 Japan ..... 48-32241

[52] U.S. Cl. ..... 148/6.2; 427/327
[51] Int. Cl.[2] ..... C23C 1/10
[58] Field of Search ..... 148/6.16, 6.2, 12, 14; 427/318, 327; 204/34; 252/79.4

[56] References Cited

UNITED STATES PATENTS 3,421,949 1/1969 Halversen ..... 148/6.2

*Primary Examiner*—William A. Powell
*Attorney, Agent, or Firm*—Toren, McGeady and Stanger

[57] ABSTRACT

A method for producing steel plate substrate for lacquering which comprises applying on the surface of the steel plate a treating solution containing 5 – 150 g/l of chromic acid, 5 – 200 g/l (as oxide) of metal oxide sol, 5 – 100 g/l of one or more selected from the group consisting of nitride, acetate, carbonate, and hydroxide of metal, borax, molybdate tungstate, and baking at a temperature of 400° C or more.

2 Claims, 9 Drawing Figures

PROCESS FOR PRODUCING STEEL PLATE SUBSTRATES FOR LACQUERING

This is a continuation of application Ser. No. 355,662 filed April 30, 1973.

The present invention relates to a process for producing steel plate substrates for lacquering, and one of the objects is to provide steel plate substrates for lacquering which are excellent in lacquerability and corrosion resistance, and another object is to supply cheap products having the above properties.

Good lacquerability is, of course, an important property required for steel plate substrates for lacquering, and even when the substrate has good lacquerability, it can not necessarily satisfactory for practical use unless it is sufficiently corrosion resistant enough to prevent corrosion under the lacquer film.

The most important properties of steel plate substrates for lacquering, therefore, are good lacquerability and excellent corrosion resistance under the lacquer film after being lacquered. Conventionally, cold rolled steel sheets were endowed with these properties by being treated either electrolytically or non-electrolytically in a treating solution containing chromic acid or phosphate. For those steel sheets used for making cans for carbonated beverages, which require high corrosion resistance of the metal substrate under the lacquer film, the corrosion resistance was enhanced with a layer of metallic chromium or with a layer of tin applied onto the metal.

The conventional treating methods are intricate and require complicated and also facilities for the treatment, thus resulting in a high production cost of the steel plates.

Under the circumstances mentioned above and after extensive investigations on the subject, the present inventors have succeeded in achieving the present invention in which a simple chemical treatment that permits high cooperating efficiency can provide a steel plate with excellent lacquerability and corrosion resistance under the lacquer film, and thereby can supply less expensive steel plate substrates for lacquering.

First, the present invention provides a process for producing steel plate substrates for lacquering comprising applying to the surface of the steel plates, a treating solution which contains 5 – 150 g/l of chromic acid, 5 – 200 g/l (as oxide) of a metal oxide scl and one or more members of a group consisting of nitrate, acetate, carbonate, and hydroxide, of a metal, borax, molybdate and tungstate in the amount of 5 – 100 g/l, and then baking at a temperature above 400° C.

Secondly, the present invention provides a process for producing base steel plate substrates for lacquering wherein the sheets are subjected to the treating steps of electrocleaning, annealing, and temper rolling of cold rolled steel strips, comprising applying the treating solution described in the first process to the cold rolled steel strips after they are electrocleaned, baking in the annealing step and then temper rolling the steel strips carrying the baked films on the surface.

The present invention will be described in detail hereinunder.

As is generally known, the surface of steel plate is covered with a film of hydrated oxide of chromium when the surface is treated with anhydrous chromic acid, dichromate or a salt thereof. Although the film of hydrated oxide of chromium positively contributes to improve rust proofness and lacquerability, but it alone can not assure good corrosion resistance of the metal under the lacquer film. In an attempt to cover the fault, the present inventors have investigated various compositions of the treating solution and the thermal treatment. As a result, it has been found that the corrosion resistance of the base metal under the lacquer film can be remarkably improved when some suitable amounts of a metal oxide sol of silicon or aluminum and one or more members of a group consisting of a nitrate, acetate, carbonate and hydroxide of a metal, borax, molybdate and tungstate are added to the treating solution containing anhydrous chromic acid, dichromate or a salt thereof, and, if necessary the pH of the solution is adjusted with acetic acid or nitric acid to dissolve the carbonate or hydroxide completely, and the solution is applied to the surface and the film formed is baked. This theory is not yet completely elucidated, but the excellert corrosion resistance of the base metal under the lacquer film is obtained by adding the two in combination.

The present invention will be explained by referring to the attached drawings.

Figure 1:
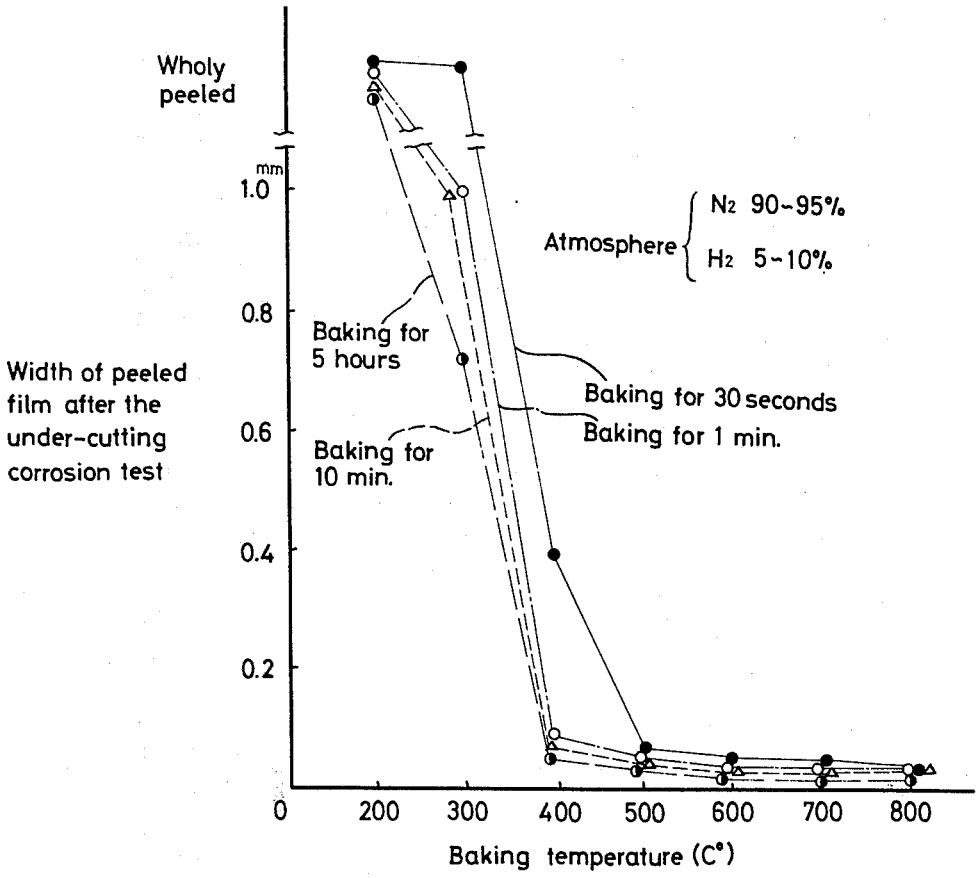
FIG. 1 and FIG. 2 show the relation between the baking temperature and the width of peeled film of specimens that have been subjected to the under-cutting corrosion test.

FIG. 1 shows the relation between the baking temperature and the corrosion resistance of the base metal under the lacquer film. In the figure the results of the under-cutting corrosion test are shown when a treating solution containing 50 g/l of anhydrous chromic acid, 100 g/l (as $SiO_2$) of silica sol and 30 g/l of nickel nitrate is applied to cold rolled steel sheets and the resultant sheets are baked at a temperature between 200° – 800° C for 30 sec., 1 and 10 min. in an atmosphere consisting of 90 – 95% of $N_2$ and 5 – 10% of $H_2$.

Figure 2:
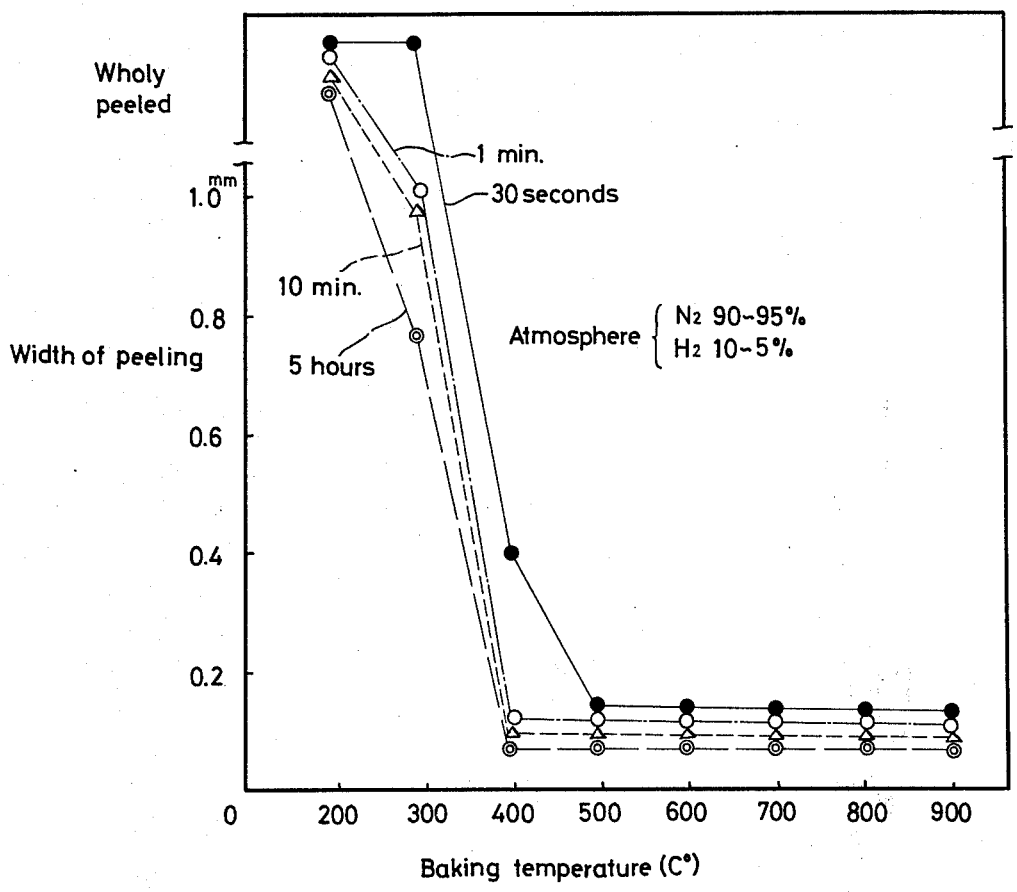

FIG. 2 shows the relation between the baking temperature and the corrosion resistance under the lacquer film. In the figure, the results of the under-cutting corrosion test are shown when a treating solution containing 50 g/l of anhydrous chromic acid, 100 g/l (as $SiO_2$) of silica sol, 35 g/l of nickel carbonate and 10 g/l of acetic acid is applied to cold rolled steel sheets and the resultant sheets are baked at a temperature between 200° – 800° C for 30 seconds, 1 minute, 10 minutes and 5 hours in an atmosphere consisting of 90 – 95% of $N_2$ and 5 – 10% of $H_2$. The paint used in both FIG. 1 and FIG. 2 was an epoxy phenol paint (DIC 83-088). The test was carried out as follows: A cross was cut on the surface of a lacquered plate with a sharp blade, and the plate was kept immersed in an aqueous 15% solution of sodium chloride (saturated with $CO_2$ gas) for 4 days at room temperature, and then width of the peeled film was measured. As is evident in FIGS. 1 and 2, the treating solution of this invention offers excellent corrosion resistance under the lacquer film by baking at an appropriate temperature.

It is necessary the baking is done at a temperature not lower than 400° C. There is no specific upper limit of the baking temperature and it should be determined from the view points of the properties of the steel plate material and economy.

Further, when one or more of a molybdate and tungstate is added to the above solution, the corrosion resistance under the lacquer film is improved further.

Restrictions imposed on the composition of the treating solution in the present invention will be explained.

The amount of anhydrous chromic acid, dichromate or salts thereof was specified as 5 – 150 g/l (as $H_2CrO_4$). With less than 5 g/l, the anti-rust property and paintability is insufficient while the surface color becomes poor with more than 150 g/l due to an increased amount of coating film.

The metal oxide sol is limited to 5 – 200 g/l calculated as oxide, and the amount of one or more members of a group consisting of a nitrate, acetate, carbonate and hydroxide of a metal, borax, molybdate and tungstate is limited to 5 – 100 g/l. For either of the component groups, corrosion resistance under the lacquer film, the most important object of this invention, is not attained if the components remain in the amount less than the lower limit as specified above. On the other hand, if they are used in an amount greater than the upper limit, the surface color as well as the adhesive power of the coating film will become poor and hence the characteristic properties of the product will deteriorate.

The nitric acid and the acetic acid are added when the metal carbonate or hydroxide is not dissolved in the treating solution, or when pH of the treating solution is increased so that the metal oxide sol becomes unstable and precipitates even if the carbonate or hydroxide is dissolved.

For example, when 10 g/l of $NiCO_3$ is added to the solution containing 40 g/l of $CrO_3$ and 50 g/l of $SiO_2$, it is not necessary to add nitric acid or acetic acid, but when 50 g/l of $NiCO_3$ is added to the solution, the $NiCO_3$ is not entirely dissolved unless nitric acid or acetic acid is added, and also, the $SiO_2$ becomes unstable and gels in several days.

The amount of nitric acid and acetic acid to be added in such a case should be determined in view of the other components.

The amount of molybdate and tungstate to be added for further improvement of the corrosion resistance under the lacquer film may be determined by the solubility of the salts used and the economical aspect.

The most conspicuous advantage obtained with the steel plates treated by the process of the present invention is that they are extremely strong in processing. In other words, the corrosion resistance under the lacquer film is not significantly lowered even under severe conditions of treatment.

Based on the strong workability of the lacquer film, the present inventors have found that the treatment of this invention can be carried out in the process for producing base plates for plating (black plate).

More particularly, the ordinary process for producing black plates for plating involves the steps of electrocleaning, annealing and temper rolling of cold rolled steel strips. The annealing is conducted usually in the temperature range of 550° – 700° C, while the temper rolling is effected usually with a reduction between 0.5 – 3%. When the present invention is applied to the process above, the electrocleaned steel strips are treated with the treating solution of this invention and the coating film is baked in the annealing strip, and the steel strips with the coating film on the surface are transferred to the temper rolling, where the characteristic property of the coating is not lowered because the baked film is sufficiently strong to withstand the working.

As has been mentioned in detail, the present invention provides black steel plates for painting by only adding a coating machine to the ordinary facilities, and hence provides the steel plate substrates for lacquering at a very low production cost.

EXAMPLE 1:

Seven treating solutions shown in Table 1 were applied to the degreased surface of cold rolled steel plates and the plates were subjected to baking process for 5 min. at 650° C in an atmosphere of 95% $N_2$ and 5% $H_2$, to obtain a 20 – 30 mg/m$^2$ (as Cr) thick coating film.

Results of the under-cutting corrosion test and observation of thready corrosion of the products, and also the results of the under-cutting corrosion test of the same which were further rolled at the 5% reduction are shown in Table 1.

Table 1

| | Composition of treating solution (3) | Baked for 5 min. at 650° C | | Rolled at 5% reduction |
|---|---|---|---|---|
| | | Under-cutting corrosion test (1) | Thready corrosion (2) | Under-cutting corrosion test (1) |
| 1 | 50 g/l anhydrous chromic acid, 100 g/l silica sol and 30 g/l nickel nitrate | less than 0.1 mm | Not observed at all | Less than 0.1 mm |
| 2 | 50 g/l anhydrous chromic acid, 100 g/l silica sol, and 30 g/l chromium nitrate | " | " | " |
| 3 | 100 g/l anhydrous chromic acid, 100 g/l alumina sol, and 30 g/l copper nitrate | " | " | " |
| 4 | 50 g/l anhydrous chromic acid, 100 g/l silica sol, and 30 g/l borax | " | " | " |
| 5 | 50 g/l anhydrous chromic acid, 100 g/l silica sol, 30 g/l nickel nitrate, and 30 g/l borax | " | " | " |
| 6 | 50 g/l anhydrous chromic acid, 100 g/l silica sol, and | " | " | " |

Table 1-continued

| | Composition of treating solution (3) | Baked for 5 min. at 650° C | | Rolled at 5% reduction |
|---|---|---|---|---|
| | | Under-cutting corrosion test (1) | Thready corrosion (2) | Under-cutting corrosion test (1) |
| 7 | 30 g/l ammonium molybdate 50 g/l anhydrous chromic acid, 100 g/l silica sol, and 30 g/l ammonium tungstate | " | " | " |

Remarks:

1. The under-cutting corrosion test was carried out in the same manner as in FIG. 1.

2. Test specimens that have been submitted to the under-cutting corrosion test were washed with water and kept in the atmosphere for as long as 5 months when observed for thready corrosion.

3. Amounts of silica and alumina sols in the composition of treating solutions are expressed as oxide.

Figure 3:
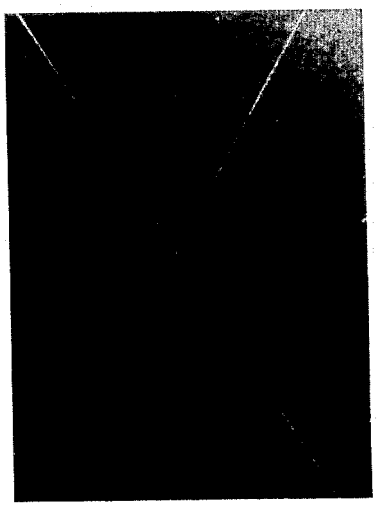
FIGS. 3 – 9 are photographs showing the results of the under-cutting corrosion test of rolled specimens.
Figure 4:
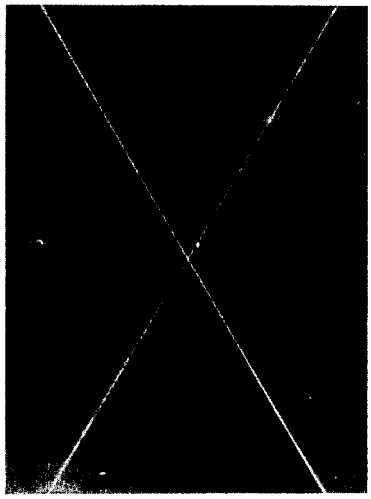
Figure 5:
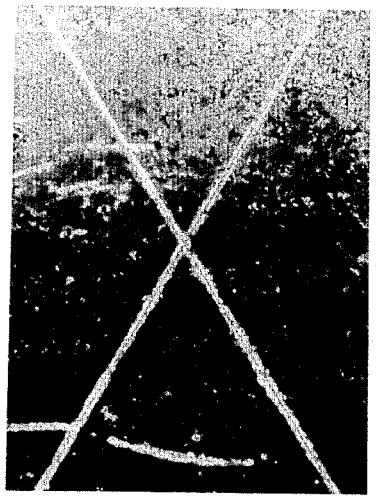

The above example shows that the process of this invention gives excellent corrosion resistance under the lacquer film regardless of the rolling treatment. Photographs in FIGS. 2 and 3 show results of the undercutting corrosion test of rolled specimens corresponding to 1 and 2, respectively, in Table 1. Further, a steel strip treated with a solution containing 50 g/l of anhydrous chromic acid, baked and then rolled, showed the width of peeled film of 0.5 – 1.0 mm in the under-cutting corrosion test. Another steel strip treated with a solution which contained 50 g/l of anhydrous chromic acid and 100 g/l (as oxide) of silica sol and further treated in the same manner as above showed the width of peeled film of 0.5 mm. In either case, however, the performance was worse than in this invention. Results of the under-cutting corrosion test in the former and the latter cases are illustrated in FIGS. 4 and 5, respectively.

EXAMPLE 2:

Five treating solutions shown in Table 2 were applied to the degreased surface of cold rolled steel plates and the plates were subjected to a baking process for 5 min. at 650° C in an atmosphere of 95% $N_2$ and 5% $H_2$ to obtain a coating of 20 – 30 mg/m$^2$ of Cr and 50 – 120 mg/m$^2$ of $SiO_2$, and subjected to the undercutting corrosion test. The results of the test and the thready corrosion are shown in the middle of Table 2, and the results of the test on the specimens rolled at 5% reduction are shown in the right column of Table 2.

Table 3 shows the results of the under-cutting test and the thready corrosion in the case of electrolytically cleaned cold rolled steel sheets which had applied thereto, a treating solution containing 50 g/l of $Cr_2O_3$. 100 g/l (as $SiO_2$) of silica sol, 20 g/l of nickel carbonate, and 10 g/l of glacial acetic acid, and then continuously annealed and temper rolled. As clearly understood from the example, the corrosion resistance under the lacquer film is remarkably improved when the baking is done during the annealing step.

Table 2

| Composition of treating solution (3) | Not rolled | | Rolled at 5% reduction |
|---|---|---|---|
| | Under-cutting corrosion test (1) | Thready corrosion (2) | Under-cutting corrosion test (1) |
| 50 g/l anhydrous chromic acid, 100 g/l silica sol 30 g/l nickel carbonate 5 g/l glacial acetic acid | Less than 0.1 mm | Not observed at all | Less than 0.1 mm |
| 100 g/l anhydrous chromic acid 100 g/l alumina sol 30 g/l nickel carbonate 5 g/l glacial acetic acid | " | " | " |
| 30 g/l anhydrous chromic acid 50 g/l silica sol 30 g/l copper carbonate 15 g/l nitric acid | " | " | " |
| 50 g/l ammonium bichromate 80 g/l silica sol 50 g/l nickel hydroxide 20 g/l nitric acid | " | " | " |
| 50 g/l ammonium bichromate 100 g/l silica sol 50 g/l zinc hydroxide 25 g/l glacial acetic acid 20 g/l ammonium | " | " | " |

Table 2-continued

| Composition of treating solution (3) | Not rolled | | Rolled at 5% reduction |
|---|---|---|---|
| | Under-cutting corrosion test (1) | Thready corrosion (2) | Under-cutting corrosion test (1) |
| molybdate | | | |

Remarks (1), (2) and (3) are same as in Table 1.

Table 3

| | Immediate after coating | After continuous annealing | After temper rolling |
|---|---|---|---|
| Under-cutting corrosion test (1) | 10-0.5 mm | Less than 0.1 mm | Less than 0.1 mm |
| Thready corrosions (2) | Observed on whole surface | Not observed at all | Not observed at all |

Figure 6:
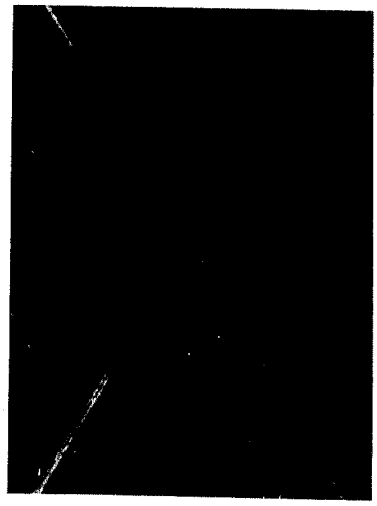
Figure 7:
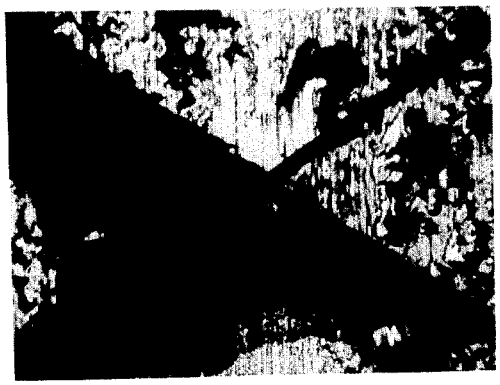
Figure 8:
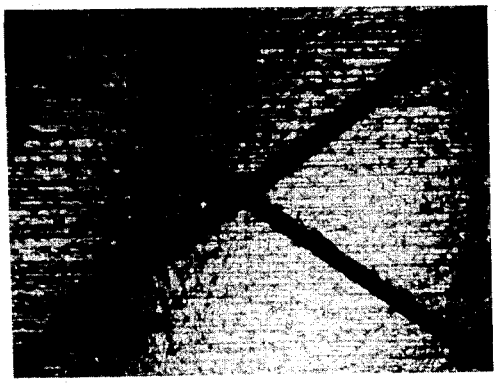
Figure 9:
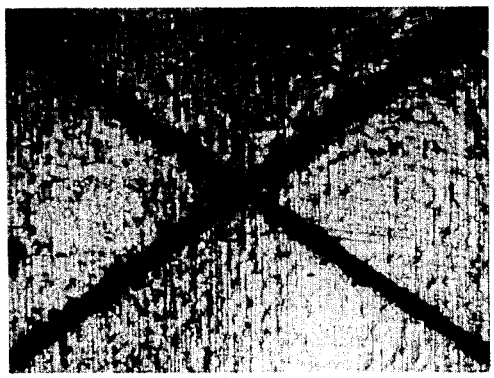

In FIGS. 6 – 8, the results of under-cutting tests on a black plate for plating, tin-free steel plate and the inventive steel plate as temper rolled are shown by the microstructures.

In conclusion, base steel plates for painting produced by the process of the present invention exhibit outstanding corrosion resistance under the painted film that is the most important property of a steel plate for painting as well as an excellent anti-rust property and paintability. Furthermore, the essential part of the process consists only of the simple steps of application of a treating solution and baking without any complex process nor plant facilities to be added to the conventional facilities. Hence, base steel plates for painting having excellent quality can be produced with less cost.

What is claimed is:

1. A method for producing a steel plate substrate suitable for lacquering which comprises applying to the surface of the steel plate a treating solution consisting essentially of 5 to 150 g/l of chromic acid, 5 to 200 g/l as oxide of a metal oxide sol of silicon or aluminum, and 5 to 100 g/l of one or more compounds selected from the group consisting of nitrates, acetates, carbonates, and hydroxides, of a metal selected from the group consisting of nickel, chromium (III), zinc, and copper, borax, molybdate and tungstate, and then baking the sheet at a temperature of at least 400° C.

2. The method of claim 1 wherein the steel plate is produced from a cold rolled steel strip which is subjected to electrolytic cleaning, and wherein the solution is applied after the electrolytic cleaning and thereafter the strip is subjected to annealing, and temper rolling, and wherein the baking is effected during the annealing step and the temper rolling is carried out on the baked steel strip.

* * * * *